US005786574A

United States Patent [19]

Garnett

[11] Patent Number: 5,786,574

[45] Date of Patent: Jul. 28, 1998

[54] BASEBALL BAT WARMER

[76] Inventor: Demetrius Garnett, 1103 Hoover St., Winters, Calif. 95964

[21] Appl. No.: 712,304

[22] Filed: Sep. 11, 1996

[51] Int. Cl.[6] ..... H05B 3/34

[52] U.S. Cl. ..... 219/529; 219/520; 126/229; 431/344; 431/345

[58] Field of Search ..... 219/520, 528, 219/529; 126/229, 226; 431/344, 345

[56] References Cited

U.S. PATENT DOCUMENTS

| | | | |
|---|---|---|---|
| 3,079,486 | 2/1963 | Winchell | 219/529 |
| 4,950,868 | 8/1990 | Moss et al. | 219/529 |
| 5,436,429 | 7/1995 | Cline | 219/535 |
| 5,687,705 | 11/1997 | Blair | 126/229 |

*Primary Examiner*—Tu B. Hoang

[57] ABSTRACT

A baseball bat warmer including an elongated cylindrical sleeve member that has a cylindrical side wall defining an interior cavity. The sleeve member is formed of a resilient material of two woven fabrics sandwiching an insulating padding. A vertical fastener releasable couples vertical edges of a vertical cut through the cylindrical side wall portion of the sleeve member. Included is a generally rectangular pouch that is open at a top edge and has a battery connector. The pouch is fixedly attached to the side wall of the sleeve member. Lastly, a battery housing is sized and shaped so as to receive a plurality of cylindrical batteries. The battery housing, with the batteries therein, is positioned within the pouch for coupling of a battery connector of the pouch with the battery connector of the housing. The batteries provide DC current to the heating wire.

8 Claims, 3 Drawing Sheets

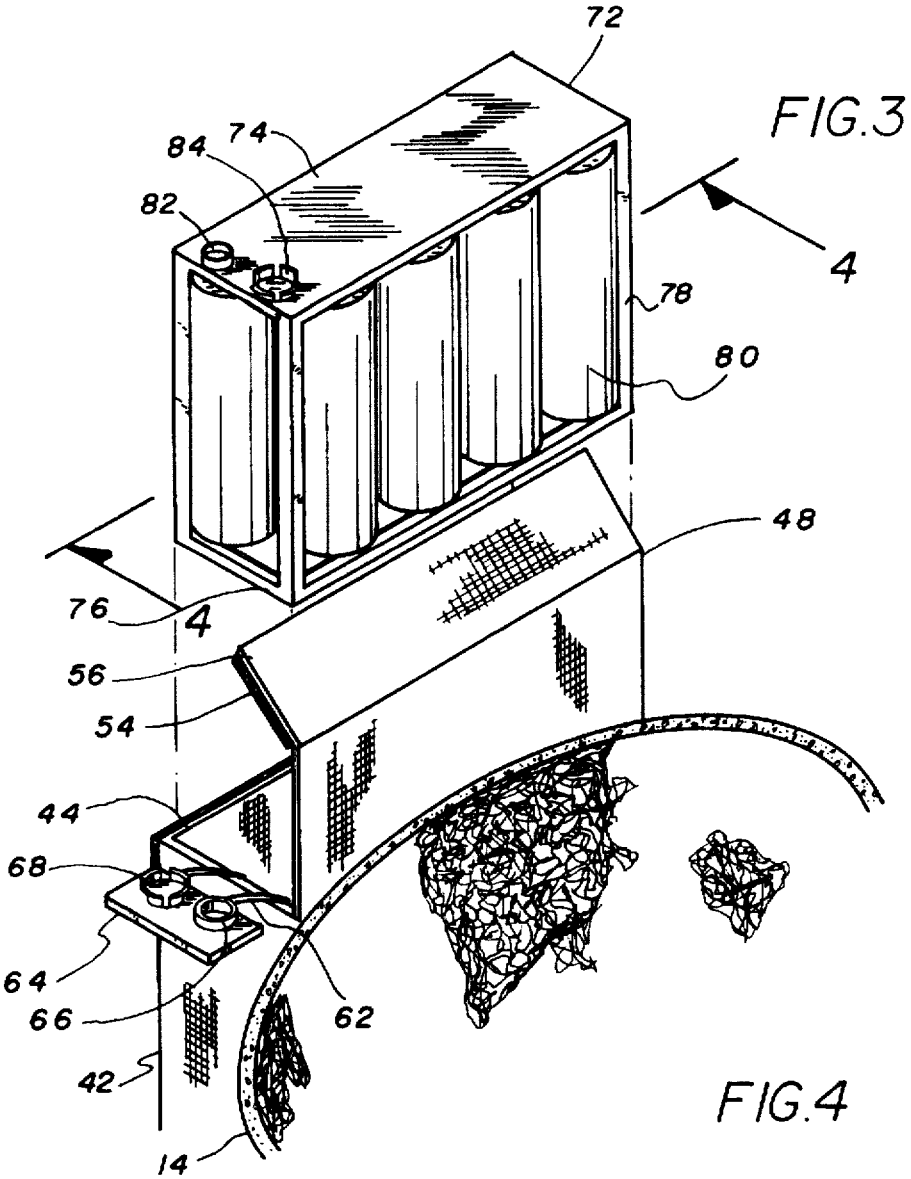
FIG.3
FIG.4
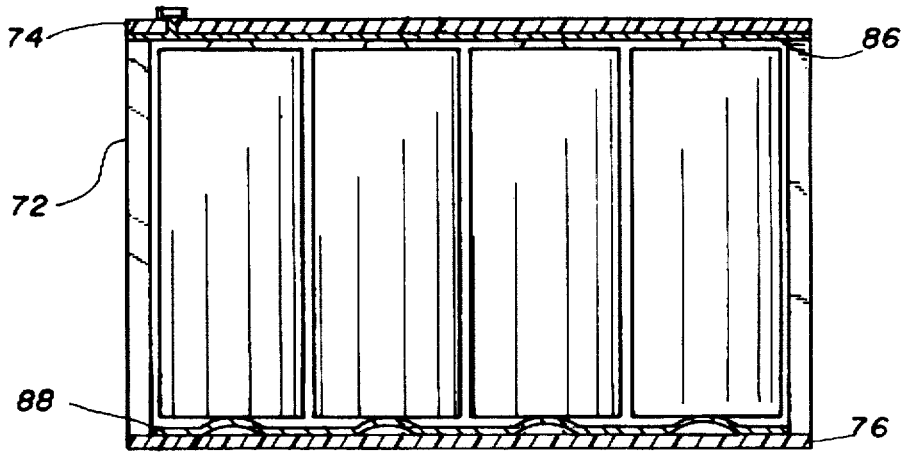

BASEBALL BAT WARMER

BACKGROUND OF THE INVENTION

1. Field of the Invention

The present invention relates to a baseball bat warmer and more particularly pertains to providing a heated sleeve for warming the hitting portion of a baseball bat during cold temperatures, and further providing a water repellant cover.

2. Description of the Prior Art

The use of a baseball bat sleeve is known in the prior art. More specifically, Baseball bat sleeves heretofore devised and utilized for the purpose of placement on a baseball bat are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,436,429 to Cline discloses a flexible electric heating pad for wrapping around a baby bottle powered by a vehicle cigarette lighter plug. U.S. Pat. No. 4,197,890 to Simko discloses a insulating jacket for bottles. U.S. Pat. Des. 319,794 to Elkins discloses a pipe wrap template. U.S. Pat. No. 5,213,324 to Bowers discloses a practice sleeve and ball. U.S. Pat. No. 5,251,460 to DeMarco and Friel discloses a cooler cover for beverage kegs. Lastly, U.S. Pat. No. 4,827,545 to Arp discloses a removable protective covering assembly for a bed restraining side rail.

While these devices fulfill their respective, particular objectives and requirements, the aforementioned patents do not describe baseball bat warmer that allows the hitting surface of a baseball bat to be warmed in cold temperatures for reduction in bat damage and contact force between the bat and ball.

In this respect, the baseball bat warmer according to the present invention substantially departs from the conventional concepts and designs of the prior art, and in doing so provides an apparatus primarily developed for the purpose of providing a heated sleeve for warming the hitting portion of a baseball bat during cold temperatures, and further providing a water repellant cover.

Therefore, it can be appreciated that there exists a continuing need for a new and improved baseball bat warmer which can be used for providing a heated sleeve for warming the hitting portion of a baseball bat during cold temperatures, and further providing a water repellant cover. In this regard, the present invention substantially fulfills this need.

SUMMARY OF THE INVENTION

In view of the foregoing disadvantages inherent in the known types of baseball bat sleeves now present in the prior art, the present invention provides an improved baseball bat warmer. As such, the general purpose of the present invention, which will be described subsequently in greater detail, is to provide a new and improved baseball bat warmer and method which has all the advantages of the prior art and none of the disadvantages.

To attain this, the present invention essentially comprises an elongated cylindrical sleeve member. The sleeve member has a cylindrical side wall with a circular top edge and a bulbous bottom. The sleeve member has a diameter increasing from the top edge to the bulbous bottom. The sleeve member defines an interior cavity that is sized and shaped so to receive a baseball bat. The sleeve member is flexible and formed of a resilient material of two woven fabrics sandwiching an insulating padding. One of the two woven fabrics is a soft fabric lining. Another of the two woven fabrics is a polymeric fabric that has water repellent properties for forming the side wall. The lining and the insulating padding are capable of sandwiching a heating wire. Included is a vertical fastening means. The vertical fastening means releasable couples the vertical edges of a vertical cut through the cylindrical side wall portion of the sleeve member. The vertical cut of the cylindrical side wall extends from a position on the top edge downwardly to a position on the side wall proximate the bulbous bottom. A generally rectangular pouch is provided. The pouch is open at a top edge and fixedly attached to the side wall of the sleeve member. The pouch has an interior cavity and a pouch flap attached to a rear side of the top edge for enclosing the interior cavity. The pouch has a pair of electrical connector cables therein that are in contact with a battery connector. The battery connector has a male and a female contact. Also, a generally rectangular battery housing is included. The housing has an upper wall and a bottom wall with each interconnected by four vertical supports. The battery housing is sized and shaped so as to receive a plurality of cylindrical batteries. The upper wall has an exterior surface with a female contact and a male contact attached. The upper wall has an interior surface with a flat contact plate that is in electrical contact with the male and female connectors of the upper wall. The bottom wall has an interior surface with a resilient contact plate. Lastly, the battery housing has the batteries and is positioned within the pouch. Positioning the housing within the pouch allows coupling of the battery connector of the pouch with the male and female contacts of the housing. The pouch flap is secured for retention of the battery housing within the pouch. The batteries, within the housing, are capable of providing AC current to the heating wire within the sleeve. Once the heating wire receives the current, the sleeve will warm the baseball bat positioned within the cavity of the sleeve member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baseball bat warmer which has all of the advantages of the prior art baseball bat sleeves and none of the disadvantages.

It is another object of the present invention to provide a new and improved baseball bat warmer which may be easily and efficiently manufactured and marketed.

It is further object of the present invention to provide a new and improved baseball bat warmer which is of durable and reliable constructions.

An even further object of the present invention is to provide a new and improved baseball bat warmer which is susceptible of a low cost of manufacture with regard to both materials and labor, and which accordingly is then susceptible of low prices of sale to the consuming public, thereby making such baseball bat warmer economically available to the buying public.

Even still another object of the present invention is to provide a baseball bat warmer for providing a heated sleeve for warming the hitting portion of a baseball bat during cold temperatures, and further providing a water repellant cover.

Lastly, it is an object of the present invention to provide a new and improved baseball bat warmer including an elongated cylindrical sleeve member that has a cylindrical side wall defining an interior cavity. The sleeve member is flexible and formed of a resilient material of two woven fabrics sandwiching an insulating padding. The insulating padding and one of the woven fabrics sandwiches a heating wire. A vertical fastening means is releasable couples vertical edges of a vertical cut through the cylindrical side wall portion of the sleeve member. Included is a generally rectangular pouch that is open at a top edge and has a battery connector. The pouch is fixedly attached to the side wall of the sleeve member. Lastly, a battery housing is sized and shaped so as to receive a plurality of cylindrical batteries. The battery housing, with the batteries therein, is positioned within the pouch for coupling of a battery connector of the pouch with the battery connector of the housing. The batteries provide DC current to the heating wire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded view of pouch in receipt of the battery housing.

FIG. 4 is a cross-sectional view of the battery housing taken along lines 4—4 of FIG. 3.

The same reference numerals refer to the same parts through the various Figures.

DESCRIPTION OF THE PREFERRED EMBODIMENT

Figure 1:
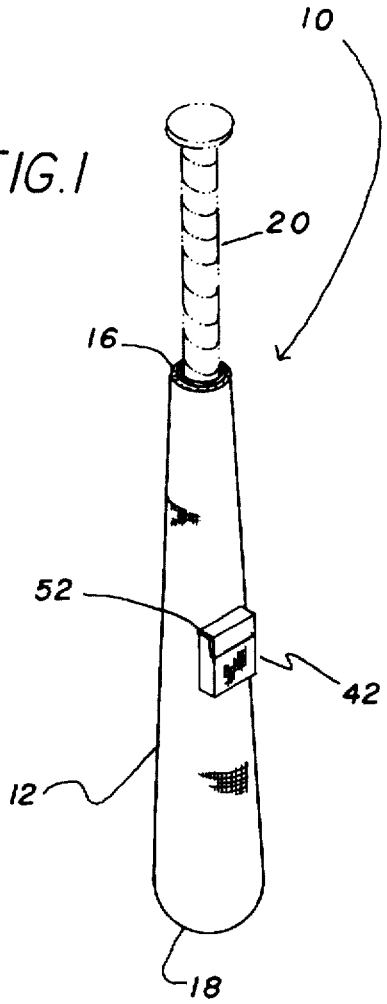
FIG. 1 is a perspective view of the preferred embodiment of the baseball bat warmer constructed in accordance with the principles of the present invention.

With reference now to the drawings, and in particular to FIG. 1 thereof, the preferred embodiment of the new and improved baseball bat warmer embodying the principles and concepts of the present invention and generally designated by the reference numeral 10 will be described.

The present invention, the baseball bat warmer 10 is comprised of a plurality of components. Such components in their broadest context include a sleeve member, a pouch and a battery housing. Such components are individually configured and correlated with respect to each other so as to attain the desired objective.

Figure 2:
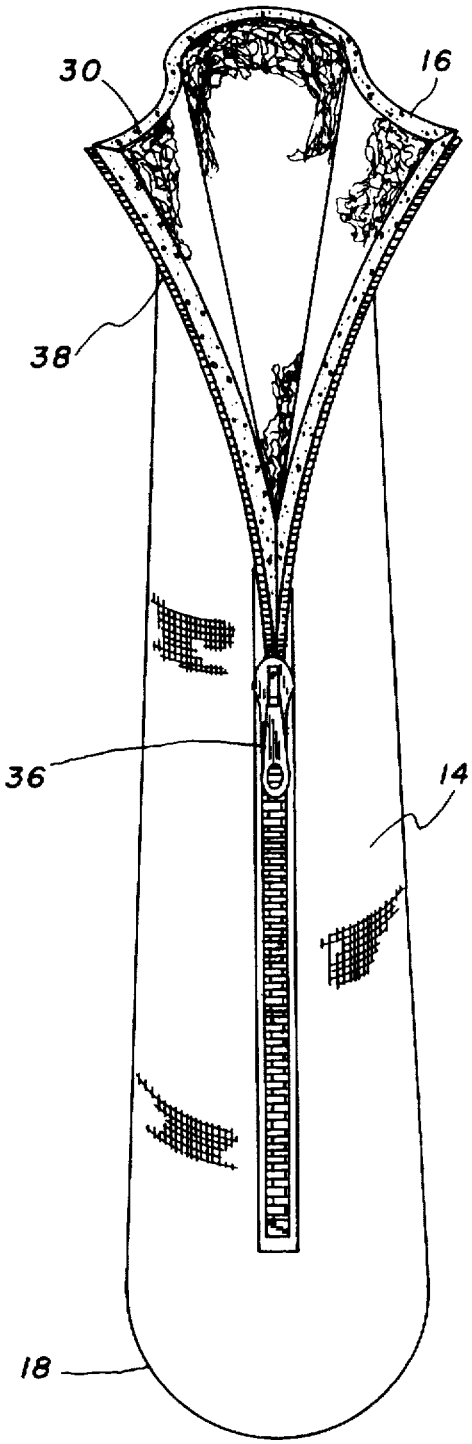
FIG. 2 is a frontal view of the baseball bat warmer of the present invention in an operable orientation.
Figure 5:
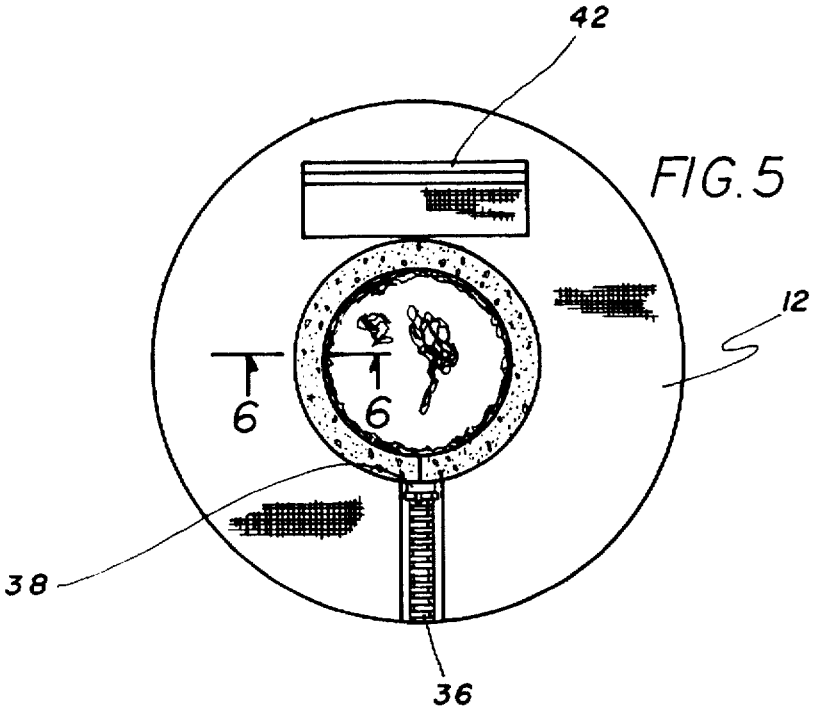
FIG. 5 is top plan view of the present invention of FIG. 2.

Specifically, the present invention includes an elongated cylindrical sleeve member 12. The sleeve member has cylindrical side wall 14 with a circular top edge 16 and a bulbous bottom 18. The sleeve member, as seen in FIGS. 2 and 5, has a diameter that increases from the top edge to the bulbous bottom. The sleeve member defines an interior cavity that is sized and shaped so to receive a baseball bat 20.

Figure 6:
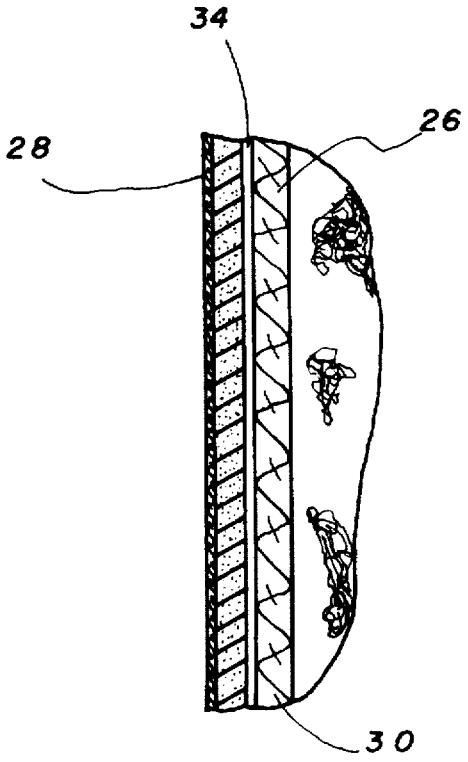
FIG. 6 is a cut-away sectional view of the sleeve member of the present invention taken along line 6—6 of FIG. 5.

Also, the sleeve member is flexible and formed of a resilient material of two woven fabrics 26 and 28 sandwiching an insulating padding 30. In FIG. 6, one of the two woven fabrics is a soft fabric lining 26. The lining may be wool or any other non abrasive light weight fabric that has a moderate heat coefficient. Another of the two woven fabrics is a polymeric fabric 28 that has water repellent properties and is used to forming the side wall. The lining and the insulating padding are capable of sandwiching a heating wire 34.

Additionally, a vertical fastening means 36 is provided. The fastening means is used for releasable coupling vertical edges of a vertical cut 38 through the cylindrical side wall portion of the sleeve member 12. In the present embodiment the fastening means is a zipper. It is to be understood that a pile-type fastener system is an alternative fastening means. The vertical cut of the cylindrical side wall extends from a position on the top edge downwardly to a position on the side wall proximate the bulbous bottom 14.

As illustrated in FIG. 1, a generally rectangular pouch 42 is included. As shown in FIG. 4, the pouch is open at a top edge 44 and fixedly attached to the side wall 14 of the sleeve member 12. The pouch is formed of the same fabric used to make the side wall of the sleeve member. The pouch has an interior cavity.

The pouch has a pouch flap 48 attached to a rear side 52 of the top edge for enclosing the interior cavity. The pouch flap and a pile-type fastener 54 attached to the underside of a front edge 56. The pile-type fastener of the pouch flap with couple with the pile-type fastener 58 of the pouch when the flap closes. The pouch has a pair of electrical connector cables 62 therein and in contact with a battery connector 64. The battery connector has a male 66 and a female 68 contacts mounted thereon.

Lastly, a generally rectangular battery housing 72 is provided. The battery housing has an upper wall 74 and a bottom wall 76 that is interconnected by four vertical supports 78. The housing is a rigid plastic that has limited flexibility. The battery housing is sized and shaped so as to receive a plurality of cylindrical batteries 80. As seen in FIG. 4, the upper wall has an exterior surface with a male contact 82 and a female contact 85 attached. The upper wall has an interior surface with a flat contact plate 86 is in electrical contact with the male and female contacts of the upper wall.

The bottom wall has an interior surface with a resilient contact plate 88 attached.

Furthermore, the battery housing 72 has the batteries positioned within the pouch 42 to couple the battery connector of the pouch with the male and female contacts of the housing. The pouch flap is secured for retention of the battery pack within the pouch. The batteries, within the housing, are capable of providing DC current to the heating wire 34 within the sleeve for warming the baseball bat when positioned within the cavity of the sleeve member 12.

The present invention baseball bat warmer is a players accessory for use in cold temperatures. The sleeve member, in keeping the bat warm, will keep the bat from being prone to damage. Cold temperatures will cause the bat to expend and become ridged. When a bats physical properties are changed because of the cold temperatures, it is more likely than not to be damaged. The sleeve member has a bat-shape with a sipper along one side. The zipper extends from the top edge to just above the bulbous bottom. The zipper allows the sleeve member to coextensively cover the hitting surface of the baseball bat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A baseball bat warmer for heating a batting surface of a baseball bat comprising in combination:

an elongated cylindrical sleeve member having a cylindrical side wall with a circular top edge and a bulbous bottom, the sleeve member having a diameter increasing from the top edge to the bulbous bottom, the sleeve member defining an interior cavity being sized and shaped so to receive a baseball bat, the sleeve member being flexible and formed of a resilient material of two woven fabrics sandwiching an insulating padding, one of the two woven fabrics being a soft fabric lining, another of the two woven fabrics being a polymeric fabric having water repellent properties for forming the side wall, the lining and the insulating padding being capable of sandwiching a heating wire therebetween;

a vertical fastening means for releasable coupling vertical edges of a vertical cut through the cylindrical side wall of the sleeve member, the vertical cut of the cylindrical side wall extending from a position on the top edge downwardly to a position on the side wall proximate the bulbous bottom;

a generally rectangular pouch being open at a top edge thereof and fixedly attached to the side wall of the sleeve member, the pouch having an interior cavity and a pouch flap attached to a rear side of the top edge of the pouch for enclosing the interior cavity of the pouch, the pouch having a pair of electrical connector cables therein being in contact with a battery connector having a male and a female contacts mounted thereon;

a generally rectangular battery housing having an upper wall and a bottom wall being interconnected by four vertical supports, the battery housing being sized and shaped so as to receive a plurality of cylindrical batteries therein, the upper wall having an exterior surface with a female contact and a male contact attached thereto, the upper wall having an interior surface with a flat contact plate being in electrical contact with the male and female connectors of the upper wall, the bottom wall having an interior surface with a resilient contact plate; and the battery housing having the batteries being positioned within the pouch for coupling of the battery connector of the pouch with the male and female contacts of the housing, the pouch flap being secured for retention of the battery housing within the pouch, the batteries within the housing being capable of providing DC current to the heating wire within the sleeve for warming the baseball bat when positioned within the cavity of the sleeve member.

2. A baseball bat warmer comprising:

an elongated cylindrical sleeve member having cylindrical side wall defining an interior cavity, the sleeve member being flexible and formed of a resilient material of two woven fabrics sandwiching an insulating padding, the insulating padding and one of the woven fabrics being capable of sandwiching a heating wire therebetween, the sleeve member having a circular top edge and a bulbous bottom, the sleeve member having a diameter increasing from the top edge to the bulbous bottom, and the sleeve member being sized and shaped so as to receive a baseball bat;

a vertical fastening means for releasable coupling vertical edges of a vertical cut through the cylindrical side wall of the sleeve member;

a generally rectangular pouch being open at a top edge of the pouch thereof and having a battery connector, the pouch being fixedly attached to the side wall of the sleeve member, the pouch having an interior cavity and a pouch flap attached to a rear side of the top edge for enclosing the interior cavity, the pouch flap being secured to the pouch with a pile-type fastener for retention of the battery housing within the pouch; and a generally rectangular battery housing being sized and shaped so as to receive a plurality of cylindrical batteries therein, the battery housing with the batteries therein being positioned within the pouch for coupling of a battery connector of the pouch with the battery connector of the housing, the batteries provide DC current to the heating wire within the sleeve.

3. The baseball bat warmer as set forth in claim 2, wherein, one of the two woven fabrics being a soft fabric lining, another of the two woven fabrics being a polymeric fabric having water repellent properties for forming the side wall, and the lining being the one wove fabric capable of sandwiching the heat wire with the insulating padding.

4. The baseball bat warmer as set forth in claim 2, wherein the vertical cut of the cylindrical side wall extending from a position on the top edge downwardly to a position on the side wall proximate the bulbous bottom.

5. The baseball bat warmer as set forth in claim 2, wherein the pouch having a pair of electrical connector cables within the interior cavity and being in contact with the battery connector, and the battery connector having a male and a female contact mounted thereon.

6. The baseball bat warmer as set forth in claim 2, wherein the battery housing having a upper wall and a bottom wall being interconnected by four vertical supports.

7. The baseball bat warmer as set forth in claim 6, wherein the upper wall of the battery housing having an exterior surface with a female contact and a male contact attached thereto, and the upper wall having an interior surface with a flat contact plate being in electrical contact with the male and female connectors of the upper wall.

8. The baseball bat warmer as set forth in claim 6, wherein the bottom wall of the battery housing having an interior surface with a resilient contact plate.

* * * * *